US009138906B2

(12) United States Patent
Okazaki

(10) Patent No.: US 9,138,906 B2
(45) Date of Patent: Sep. 22, 2015

(54) SCORING DEVICE FOR GYPSUM BOARD PRODUCTION DEVICE

(75) Inventor: Shoichi Okazaki, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 916 days.

(21) Appl. No.: 12/312,038

(22) PCT Filed: Oct. 25, 2007

(86) PCT No.: PCT/JP2007/070859

§ 371 (c)(1),
(2), (4) Date: Apr. 23, 2009

(87) PCT Pub. No.: WO2008/056544

PCT Pub. Date: May 15, 2008

(65) Prior Publication Data

US 2010/0048372 A1 Feb. 25, 2010

(30) Foreign Application Priority Data

Nov. 7, 2006 (JP) ..... 2006-302158

(51) Int. Cl.

| | |
|---|---|
| ***B31F 7/00*** | (2006.01) |
| ***B26D 3/08*** | (2006.01) |
| ***E04F 13/04*** | (2006.01) |

(Continued)

(52) U.S. Cl.

CPC ... *B26D 3/08* (2013.01); *B31F 1/10* (2013.01); *E04F 13/04* (2013.01); *B26D 7/20* (2013.01); *B28B 19/0092* (2013.01); *B31B 2201/257* (2013.01)

(58) Field of Classification Search

USPC ..... 493/355, 403, 402, 241, 161, 34, 82, 83

See application file for complete search history.

(56) References Cited

U.S. PATENT DOCUMENTS 1,302,831 A * 5/1919 Naugler ..... 493/396
3,157,398 A * 11/1964 Zahradnik ..... 493/397

(Continued)

FOREIGN PATENT DOCUMENTS

CN 2668385 1/2005
CN 2790708 6/2006

(Continued)

OTHER PUBLICATIONS

Chinese Office Action for corresponding Chinese Application 200780040357.0; dated May 12, 2010.

(Continued)

*Primary Examiner* — Sameh Tawfik

(74) *Attorney, Agent, or Firm* — Staas & Halsey LLP

(57) ABSTRACT

The invention provides a whetstone type of scoring device for production of gypsum boards which can accurately and stably form a groove of a constant depth on a sheet of paper for gypsum board liner, and which can prevent wear of a rotary blade and a backing block. The scoring device (11) for a gypsum board production machine (10) has the rotary blade (24) and the backing block (30). The sheet (3) travels under tension over the block (30), which abuts against the lower surface of the sheet. The block has an opening (32) immediately under the blade. The lower surface of the sheet is released downward by the opening. The sheet is ground by a blade edge (24*a*) while being slightly bent downward within a range of the opening (within an intimate contact area of an angle β).

15 Claims, 9 Drawing Sheets

(51) Int. Cl.

| | |
|---|---|
| ***B31F 1/10*** | (2006.01) |
| *B28B 19/00* | (2006.01) |
| *B26D 7/20* | (2006.01) |

(56) References Cited

U.S. PATENT DOCUMENTS

| | | | | | |
|---|---|---|---|---|---|
| 3,314,339 | A | * | 4/1967 | Guffy et al. | 493/403 |
| 3,359,773 | A | * | 12/1967 | Stuchbery | 72/325 |
| 3,643,553 | A | * | 2/1972 | Morimoto | 493/373 |
| 3,877,353 | A | * | 4/1975 | Smith et al. | 493/373 |
| 3,956,974 | A | * | 5/1976 | Schroter | 493/342 |
| 4,295,842 | A | * | 10/1981 | Bell | 493/342 |
| 4,417,883 | A | | 11/1983 | Granger et al. | |
| 4,725,261 | A | * | 2/1988 | Millard et al. | 493/82 |
| 5,549,539 | A | * | 8/1996 | Rautenberg | 493/402 |
| 6,071,222 | A | * | 6/2000 | Schneider | 493/355 |

FOREIGN PATENT DOCUMENTS

| | | |
|---|---|---|
| JP | 58-49206 | 3/1983 |
| JP | 2-286205 | 11/1990 |
| JP | 8-150675 | 6/1996 |

OTHER PUBLICATIONS

International Search Report for International Application PCT/JP2007/070859 mailed Jan. 29, 2008.

* cited by examiner (A)

(B)

SCORING DEVICE FOR GYPSUM BOARD PRODUCTION DEVICE

BACKGROUND OF THE INVENTION

The present invention relates to a scoring device for a gypsum board production machine, and more specifically, to such a device which continuously forms a score on a sheet of paper for gypsum board liner traveling under tension.

Gypsum boards, each having a gypsum core covered with sheets of paper for gypsum board liner, are known as building materials for interior finish. The gypsum boards are mass-produced by gypsum board production machines, and circulated on the market. In general, the gypsum board production machine is provided with a conveying device for continuously conveying the sheet of paper for gypsum board liner (lower sheet); a scoring device for scoring the sheet on its side edge portions; a mixer for preparing a gypsum slurry; a folding device for folding the sheet to configure edge portions of the board; a laminating and forming device for laminating another sheet of paper for gypsum board liner (upper sheet) onto the gypsum slurry; a cutting device for cutting a continuous web-like form into green boards having a predetermined board length; a drying device for drying excessive water contained in the boards; and a delivery device for delivering products, which are the boards finely cut to be a predetermined product size.

The scoring device continuously forms scores on the sheet of paper for gypsum board liner, which travels under tension. The scoring device is known, which is constituted from a folding-line forming part such as a disc-shaped whetstone or a pressing part, and a driving device for rotating or energizing the forming part. The forming part forms a notch or crease on the sheet of paper (lower sheet) to provide the score thereon. The scoring device also has manually operated lifting means for displacing the forming part in a direction of the thickness of the sheet, and manually operated moving means for displacing the forming part in a widthwise direction of the sheet. The position of the score to be formed on the sheet is adjusted by manual operation of the lifting means and the moving means.

As the scoring device of the gypsum board production machine, a folding-line forming device is disclosed in Japanese Patent Laid-open Publication No. 58-86937 (JP-A-58-86937), in which the sheet of paper for gypsum board liner is passed between a folding-line forming part and a backup roller by a conveyance device so that a folding line is formed on the sheet under pressure of the forming part.

Further, a method of bending a thick sheet such as a corrugated fiberboard for producing a box or the like is disclosed in Japanese Patent Laid-open Publication No. 08-150675 (JP-A-08-150675), in which a notch in a form of wedge is made on the sheet by a knife and the sheet is bent accurately on the notch.

The sheet of paper for gypsum board liner is a sheet of about 0.3 mm in thickness and about 200 g/m$^2$ in weight. The knife as disclosed in JP-A-08-150675 is merely a knife used for forming the wedge-shaped notch on the thick sheet of paper such as a corrugated fiberboard, and therefore, such a knife cannot be used for scoring the sheet of paper for gypsum board liner.

On the other hand, the device disclosed in JP-A-58-86937 is a creaser type of scoring device which presses the folding-line forming part against the sheet of paper for gypsum board liner so that a folding line is formed by locally pressing action on the sheet. This type of scoring device is finely adjusted by a skillful operator, and the adjustment depends on experience of the operator.

In recent years, reduction of a thickness of the sheet of paper has been desired for reduction of production costs, improvement of recycling recovery of gypsum boards, and so forth. Under such circumstances, a thin sheet of paper of about 0.2 mm in thickness and about 140 g/m$^2$ in weight may be used as the sheets of paper for gypsum board liner. In addition, the tension imposed on the sheet has tended to be increased in relation with speeding-up of the gypsum board production line in recent years. In such a production condition, load on the sheet of paper is increased and a fracture of the sheet is apt to be caused. Therefore, it is difficult to employ the creaser type of scoring device in which the fine adjustment depends on the experience of the skillful operator.

Further, in consideration of workability of gypsum boards, it is preferable that the edge portion of the gypsum board has a precise and sharp corner. In general, the angle of the corner of the edge portion is normally managed to be a substantially right angle. However, in a case of the creaser type of scoring device, the angle of the edge portion is apt to exceed 90 degrees, whereby the gypsum boards having an undesirable appearance may be produced as the result of corners without sharpness. This results in decreased yields and low productivity.

In consideration of such problems, whetstone types of scoring devices are usually employed in Japan.

FIGS. 10 (A) and 10 (B) are cross-sectional views schematically showing a structure of a whetstone type of scoring device. FIG. 10 (C) is a partial plan view of a backing block. FIGS. 10 (D) and 10 (E) are partial cross-sectional views of a sheet of paper for gypsum board liner showing cross-sections of a score on the sheet.

The scoring device has a disc-shaped rotary blade A concentrically fixed on a rotary drive shaft B. A backing block C is positioned under the blade A. The sheet of paper for gypsum board liner D travels on the block C in a direction of an arrow E. The blade A rotates in a normal rotational direction (a direction of an arrow) or a reverse direction with rotation of the shaft B. The blade A grinds an upper layer of the sheet D to form a groove G on the sheet D.

This type of scoring device allows a relatively sharp corner to be formed on the edge portion of the gypsum board. Further, this type of scoring device facilitates management to make a substantially right angle in the edge portion. Therefore, such a scoring device is preferably employed in order to prevent a yield of production from being decreased due to the inaccurate angle of the edge portion.

However, the blade A and the block C in this type of scoring device are apt to be worn. Therefore, the blade and the block have to be replaced with new parts relatively frequently, in relation with the tendency of speeding-up of the gypsum board production line.

Further, in the whetstone type of scoring device, the depth of the groove G is apt to change, owing to a slight eccentricity of the shaft B and the blade A, change in the tension on the sheet D and so forth. Therefore, the groove G thus formed tends to have an irregular depth as shown by a dotted line on FIG. 10 (E). This tendency has been noticeably observed especially in recent years, owing to reduction in the thickness of the sheet of paper for gypsum board liner and speeding-up of the gypsum board production line. This results in a problem of discontinuous or intermittent folding lines formed on the sheet.

BRIEF SUMMARY OF THE INVENTION

The present invention has been contrived in view of such circumstances, and an object of this invention is to provide a whetstone type of scoring device for production of the gypsum boards which can accurately and stably form a groove of a constant depth on a sheet of paper for gypsum board liner.

Another object of the invention is to provide a whetstone type of scoring device for production of the gypsum boards which can prevent wear of the rotary blade and the backing block in order to reduce replacement frequency of the blade and the block.

To accomplish the above object, the present invention provides a scoring device for a gypsum board production machine having a rotary blade and a backing block, in which the blade is in contact with an upper surface of a sheet of paper for gypsum board liner traveling under tension, the block abuts against a lower surface of the sheet, and a score is continuously formed on the sheet by the blade, characterized in that the backing block is formed with an opening immediately under said blade, and a lower surface of a part of said sheet is downwardly released by the opening while the part of the sheet is ground by said blade.

According to the arrangement of the present invention described above, the opening of the backing block downwardly releases the lower surface of the part of the sheet ground by the rotary blade. The sheet is in contact with a blade edge of the blade while being bent downward in a range of the opening. The sheet passing the blade is formed with a groove on the upper surface of the sheet. The sheet is also formed with a folding line protruding downward. It has been found that the groove made in such a manner has a constant depth without irregularity of the depth as observed in the conventional scoring device, and that the folding line is formed on the lower surface of the sheet relatively finely. This results from the arrangement of the scoring device of this invention wherein the sheet is curved downward in the range of the opening so as to be kept in contact with the blade edge of the blade throughout a certain distance, which differs from the arrangement of the conventional scoring device wherein the blade is substantially in point contact with the sheet.

According to the scoring device with such an arrangement, the tearing or fracture of the sheet or the like can be prevented from being caused owing to irregularity of the depth of the groove. Therefore, the scoring device according to the present invention can be adapted to deal with the aforementioned trend in recent years, such as reduction in the thickness of the sheet of paper for gypsum board liner and speeding-up of the gypsum board production line.

Further, the edge portion of the sheet can be folded with accuracy under action of the folding device following the scoring device, since the folding line is formed on the sheet relatively finely.

Furthermore, the scoring device with the arrangement as set forth above can prevent wear of the rotary blade and the backing block, so that the replacement frequency of the blade and the block can be reduced. This is considered to result from release of the lower surface of the sheet in the range in which the blade acts on the sheet.

From another aspect, the present invention provides a method of producing a gypsum board including a scoring process with use of a rotary blade and a backing block, in which the blade is in contact with an upper surface of a sheet of paper for gypsum board liner traveling under tension and the block abuts against a lower surface of the sheet, whereby a score is continuously formed on the upper surface of the sheet by the blade, characterized in that the lower surface of said sheet is partially released by an opening of said block formed immediately under said blade; and the blade is brought into contact with a part of the sheet over the opening throughout an angular range of a predetermined central angle (β) about a center axis of the blade in order to form the score on the sheet.

According to the present invention, the groove of a constant depth can be accurately and stably formed on the sheet of paper for gypsum board liner, and the rotary blade and the backing block can be prevented from being worn out, so that replacement frequency of the blade and the block is reduced.

BRIEF DESCRIPTION OF DRAWINGS

FIG. 3(B) is a side elevational view showing a structure of a scoring unit;

EXPLANATION OF REFERENCE NUMERALS

Figure 1:
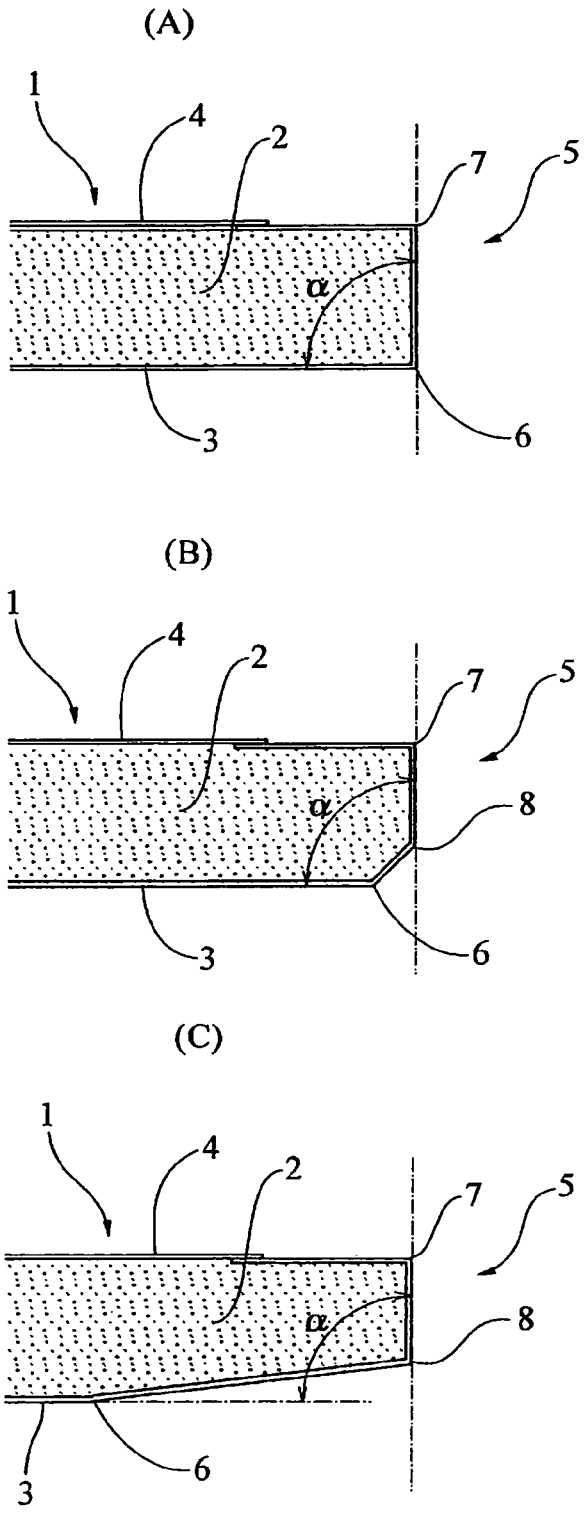
FIG. 1 is a partial cross-sectional view of gypsum boards showing configurations of edge portions of the gypsum boards.

1: gypsum board
3: sheet of paper for gypsum board liner (lower sheet)
9: groove
9*a*: folding line
10: gypsum board production machine
11: scoring device
20: scoring unit
21: tension roll
22: support frame
23: electric motor
24: rotary blade
24*a*: blade edge
25: rotary drive shaft
30: backing block
31: body of backing block
32: opening
40: vertical carrier mechanism
41: vertical operation mechanism
50: horizontal carrier mechanism
51: horizontal operation mechanism

60: control unit
70: control panel

DETAILED DESCRIPTION OF THE INVENTION

In a preferred embodiment of the invention, the opening of the backing block is formed throughout an angular range of a certain central angle about the center axis of the rotary blade (for example, the angular range of 15 degrees about the center axis). The central angle is set to be from 10 degrees to 90 degrees. The sheet of paper for gypsum board liner is in intimate contact with the blade throughout an area corresponding to this central angle. Preferably, the central angle is set to be between 10 degrees and 30 degrees. In such a configuration, the sheet is curved downward within the intimate contact area corresponding to the central angle of at least 10 degrees (e.g., 15 degrees), and the sheet is kept in contact with the blade therein. Thus, a constant groove and a folding line can be surely formed on the sheet. In this specification, the "intimate contact" means a state of contact in such a manner that an object is enveloped, or a state of line to line contact in a form of arc.

In a more preferable embodiment of the invention, the scoring device has a carrier mechanism which movably supports a driving device for rotating the rotary blade, and a moving mechanism which moves the driving device. Preferably, the carrier mechanism is provided with a vertical carrier mechanism which vertically movably supports the driving device, and horizontal carrier mechanism which horizontally movably supports the vertical carrier mechanism. The moving mechanism is provided with the vertical driving mechanism which vertically moves the driving device, and the horizontal driving mechanism which horizontally moves the driving device.

According to the scoring device of this invention, the sheet is bent in the range of opening to be kept in contact with the blade throughout a certain distance, and therefore, the groove of a constant depth can be accurately and stably formed on the sheet. Further, the blade and the block are prevented from being worn. Therefore, it is possible to preset or anticipate the action of the blade on the sheet quantitatively. This enables setting or adjustment of the position of the blade in dependence on a mechanical structure. That is, in the scoring device having the aforementioned arrangement, a vertical position of the blade can be set by vertical displacement of the driving device, which is carried out by the vertical driving mechanism, and the horizontal position of the blade can be set by horizontal displacement of the driving device, which is carried out by the horizontal driving mechanism, whereby the action of the blade on the sheet can be preset or adjusted. As the result, conventional fine adjustment work depending on manually performed manipulation can be eliminated, and setting and adjustment of the position of the blade can be mechanized and automated by mechanical means.

More preferably, the scoring device has a detecting means for detecting the position of the blade, and controller for operating the vertical driving mechanism and the horizontal driving mechanism on the basis of the detected result of the detecting means. It is desirable that the controller is provided with a memory section for storing positional information of the blade in relation to the dimensions and configurations of the gypsum boards. In the scoring device according to the present invention, the blade can be always located at an optimum position in a case where the same type of gypsum board is periodically produced. Therefore, a production error or the like resulting from manual operation can be eliminated, and constant gypsum board products can be stably produced. Further, if the positional information of the blade is memorized in the controller in relation to the dimensions and configurations of the gypsum boards, change of position of the blade can be readily and quickly carried out when the type of gypsum board to be produced is changed. Thus, it is possible to reduce the standby time and so forth when the type of gypsum board to be produced is changed.

Preferred examples of the present invention will be described below in detail with reference to the accompanying drawings.

FIG. 1 is a partial cross-sectional view showing configurations of edge portions of gypsum boards.

A gypsum board 1 comprises a gypsum core 2 covered with a sheet of paper for gypsum board liner (lower paper) 3 and a sheet of paper for gypsum board liner (upper paper) 4. The gypsum board 1 with a square edge is illustrated in FIG. 1A. An edge angle $\alpha$ of an edge portion 5 of the gypsum board is set to be a right angle. The sheet 3 is formed with folding lines in positions corresponding to corners 6, 7. The gypsum board 1 with a beveled edge is illustrated in FIG. 1B, wherein the sheet 3 is formed with folding lines in positions corresponding to the corners 6, 7, 8. The gypsum board 1 with a tapered edge is illustrated in FIG. 1C, wherein the sheet 3 is formed with folding lines in positions corresponding to the corners 6, 7, 8.

In production of the gypsum boards, the edge angle $\alpha$ of the edge portion 5 is managed to be a substantially right angle. If the edge angle $\alpha$ of the gypsum board 1 does not fall under such an angle (for instance, the board 1 has the angle $\alpha$ significantly exceeding 90 degrees), it is difficult to ensure desirable workability of the gypsum boards 1 during installation. For example, the gypsum boards 1 with the square edges are attached to a substrate for interior finish, such as a light weight steel stud or the like, and a joint between the adjacent boards 1 is a butt joint. In order to facilitate, simplify or omit puttying work for such a butt joint, it is desirable that the edge angle $\alpha$ be accurately a right angle. Even if an error is tolerable to some extent, the angle $\alpha$ should be a substantially right angle.

Figure 2:
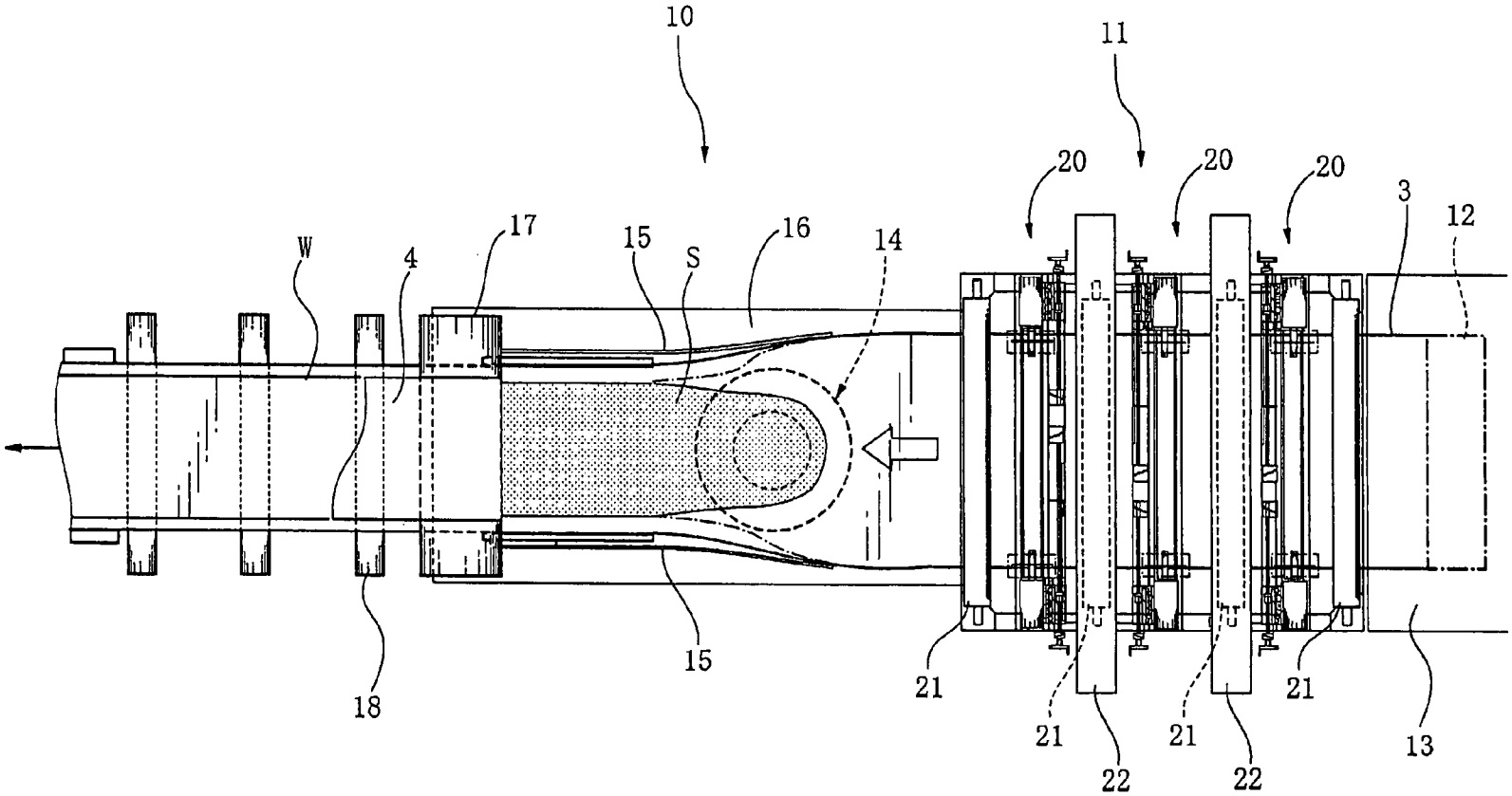
FIG. 2 is a plan view schematically showing an arrangement of a gypsum board production machine.

FIG. 2 is a plan view schematically showing an arrangement of a gypsum board production machine. FIG. 3(A) is a side elevational view showing a structure of a scoring device which is an example of the present invention, and FIG. 3(B) is a side elevational view showing a structure of a scoring unit.

A sheet of paper for gypsum board liner (lower paper) 3 is supplied to the gypsum board production machine 10 in a form of an endless roll of paper having a predetermined width. As shown in FIG. 3(A), a paper roll 12 of the sheet 3 is positioned above a feed table (a table for receiving the paper) 13. The sheet 3 is fed from the roll 12 and conveyed in its lengthwise direction by paper conveyance means (not shown) of the machine 10. The machine 10 is provided with a scoring device 11 for forming scores on the sheet 3 and a mixer 14 for preparation of gypsum slurry S. The mixer 14 deposits the slurry S on the sheet 3 formed with the scores thereon. Right and left folding devices 15 are provided in a pair on a conveyer plate 16, so that side edge zones of the sheet 3 are pressed inwardly by the devices 15. The device 15 abuts against each of the side zones of the sheet 3 so as to fold the sheet 3 upward on its scores. A sheet of paper for gypsum board liner (upper paper) 4 is fed from a paper roll of the upper sheet of paper (not shown). The sheet 4 turns on a turning roller 17 for laminating the upper sheet 4 on the gypsum slurry S. The sheets 3, 4 and the slurry S are conveyed on rotary rollers 18 of the conveyance device as a continuous web-like formation W. The formation W is transferred to a roughly cutting device (not shown) to be roughly cut, and then, transferred through a dryer (not shown) to a finely cutting device (not shown) to be finely cut into a gypsum board product of a predetermined product length.

Figure 3:
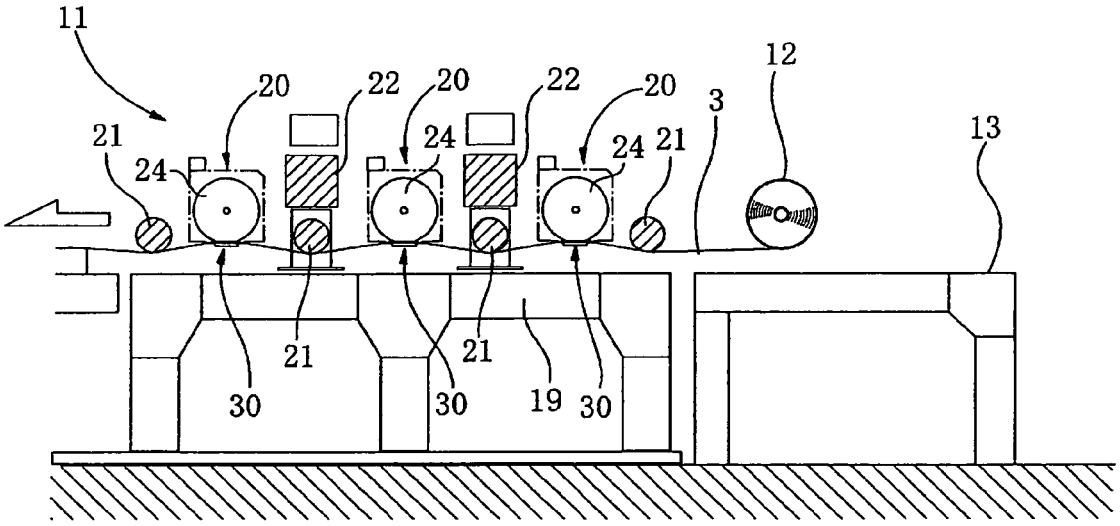
FIG. 3 (A) is a side elevational view showing a structure of a scoring device which is an example of the present invention.
Figure 3:
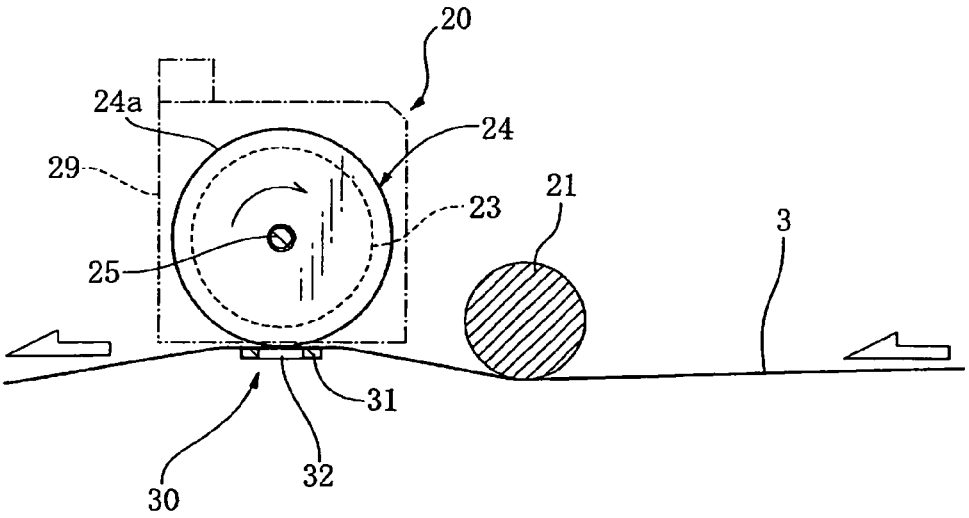

As shown in FIG. 3, the scoring device 11 has four tension rolls 21 and three sets of scoring units 20. The rollers 21 are equally spaced apart from each other. The scoring unit 20 is located between the rollers 21. Two support frames 22 are provided between the scoring units 20. The scoring units 20 are supported by the frames 22 and the frame 22 is supported by a framework 19.

Each of the scoring units 20 has an electric motor 23 (shown by a dotted line), a disc-shaped rotary blade 24, a backing block 30, a pair of journaled rollers (not shown), and a safety cover 29 (shown by phantom lines). The blade 24 is concentrically fixed on a rotary drive shaft 25 of the motor 23. The block 30 is positioned immediately below the blade 24. The block 30 is located between the journaled rollers. The cover 29 covers a blade edge of the blade 24. The blade 24 has a diameter larger than that of the motor 23 and contained in the cover 29. The journaled roller is supported on a beam (not shown) of the framework 19 by bearing means (not shown).

The sheet 3 is pulled and conveyed under tension by the paper conveyance means, in a direction as shown by an arrow. Therefore, the sheet 3 is normally subjected to a predetermined tension. A path of the sheet 3 is determined by the tension rollers 21 and the journaled rollers. Thus, the tension is stably imposed on the sheet 3 moving over the block 30 by action of the rollers 21 and the journaled rollers. The blade 24 rotates in a normal direction of rotation as shown by an arrow on FIG. 3. The blade 24 is provided with the blade edge 24*a* on its periphery. In a contact area of the blade 24 and the sheet 3, the blade edge 24*a* moves in the same direction as that of the conveyed sheet 3.

Figure 4:
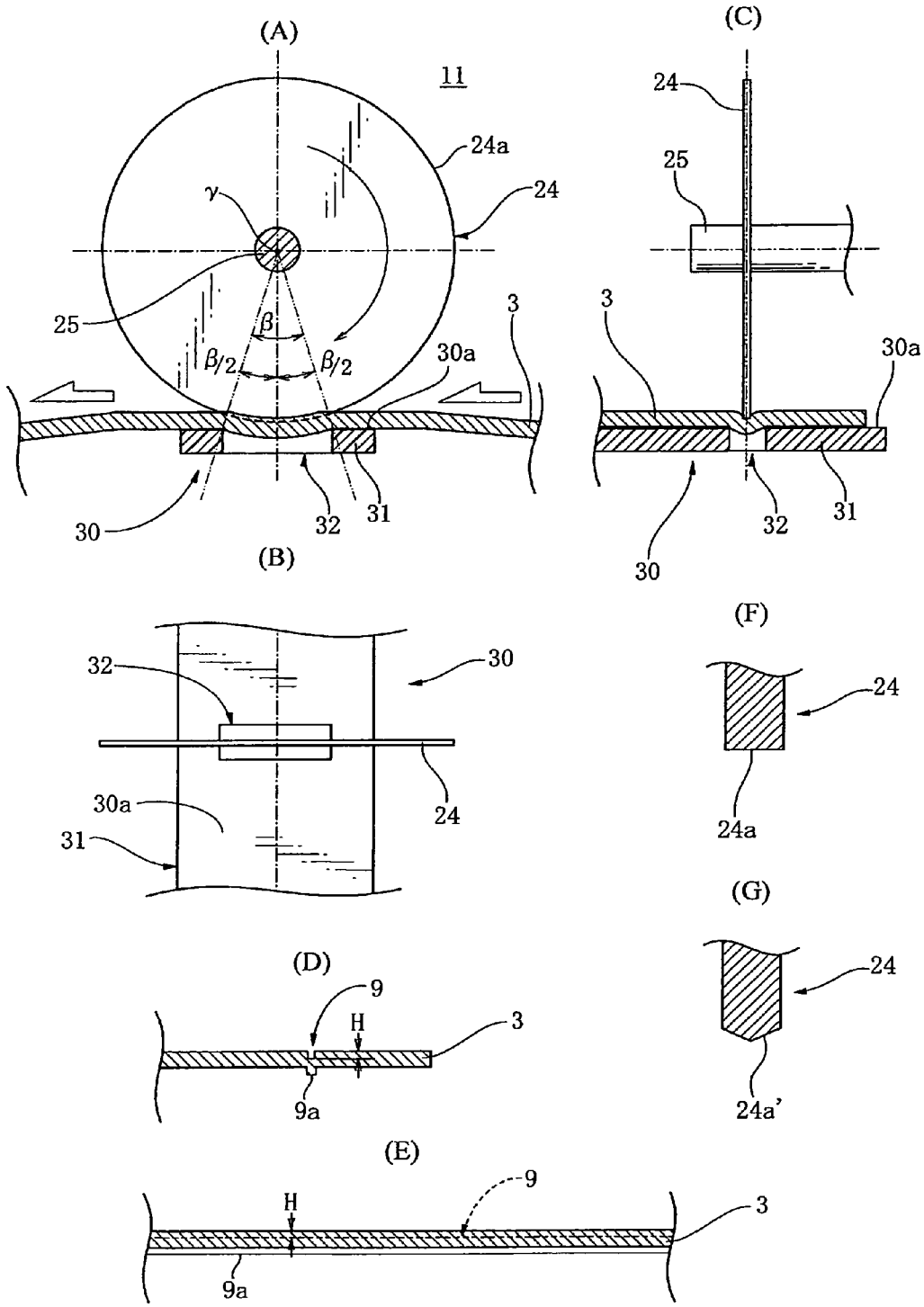
FIGS. 4 (A) and 4 (B) are cross-sectional views showing configurations of a rotary blade and a backing block, FIG. 4 (C) is a partial plan view of the backing block, FIGS. 4 (D) and 4 (E) are partial cross-sectional views of a sheet of paper for gypsum board liner showing cross-sections of score formed on the sheet, and FIGS. 4 (F) and 4(G) are enlarged cross-sectional views showing configurations of the blade edge.

FIGS. 4 (A) and 4 (B) are cross-sectional views showing configurations of the rotary blade 24 and the backing block 30. FIG. 4 (C) is a partial plan view of the backing block 3. FIGS. 4 (D) and 4 (E) are partial cross-sectional views of the sheet 3 showing cross-sections of the score formed on the sheet 3.

The backing block 30 has a body 31 and a square or rectangular opening 32. The body 31 is a metal part having a rectangular cross-section, and the opening is formed right below the blade 24. The body 31 has a horizontal upper surface 30*a*. The opening 32 has a rectangular profile as seen in the plan view and vertically extends through the body 31 as a through-hole having a uniform cross-section.

A part of the sheet is ground by the blade 24. The opening 32 releases a lower surface of such a part of the sheet. The blade 24 is in contact with the sheet 3 immediately above the opening 32, and the blade edge 24*a* on the periphery of the blade 24 scrapes at least an uppermost layer of the layers of the sheet 3. As shown in FIGS. 4 (D) and 4 (E), a groove 9 is formed on the surface of the sheet 3, and the lowermost layer of the sheet 3 forms a folding line 9*a*. From an aspect of wear-resistance and durability, a diamond whetstone is preferably employed as a material of the blade edge 24*a*. Various configurations of the blade edge, such as a flat-type or a tip-type configuration, may be employed as a configuration of the blade edge 24*a*. From an aspect of wear-resistance, the flat-type configuration is preferably employed. In FIG. 4 (F), the flat-type configuration of the blade edge 24*a* is depicted, whereas the tip-type configuration of the blade edge 24*a*' is depicted in FIG. 4 (G). The blade edge 24*a*, 24*a*' may be made of a material for grinding the sheet of paper for gypsum board liner 3, such as a material of a conventional grinding wheel. Further, a blade with a saw-toothed configuration of blade edge may be employed.

As the lower surface of the sheet 3 is released by the opening 32, the sheet 3 is slightly bent downward in a range of the opening 32 (in an intimate contact area corresponding to a central angle β of the blade 24). The sheet 3 is kept in contact with the blade edge 24*a* in the range of the opening 32, and the grinding action of the blade edge 24*a* is maintained in the range of the opening 32. As the result, the groove 9 having a depth H is formed on the upper surface of the sheet 3 passing under the blade 24, and the folding line 9*a* is formed to protrude from the lower surface of the sheet 3. Since the protrusion of the folding line 9*a* is ensured, the depth H of the groove 9 is stably obtained.

In such a way of scoring, it has been found that the folding line 9*a* is formed relatively clearly, that the depth H of the groove 9 is stable, and that the edge portion of the sheet 3 can be precisely folded at the angle α=substantially right angle by the successive action of the folding device 15.

Figure 5:
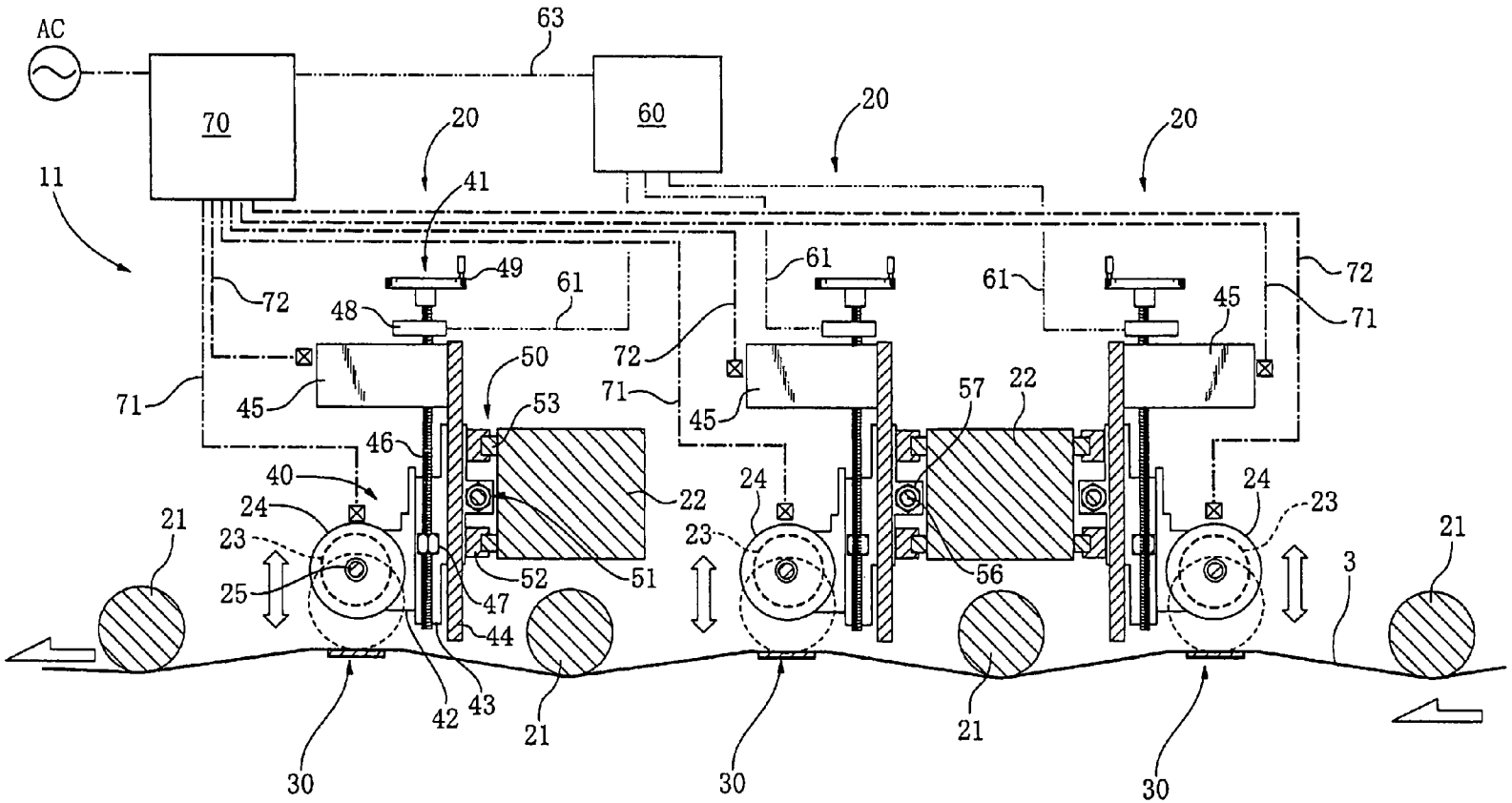
FIG. 5 is a partially cross-sectional side elevational view of the scoring device.
Figure 6:
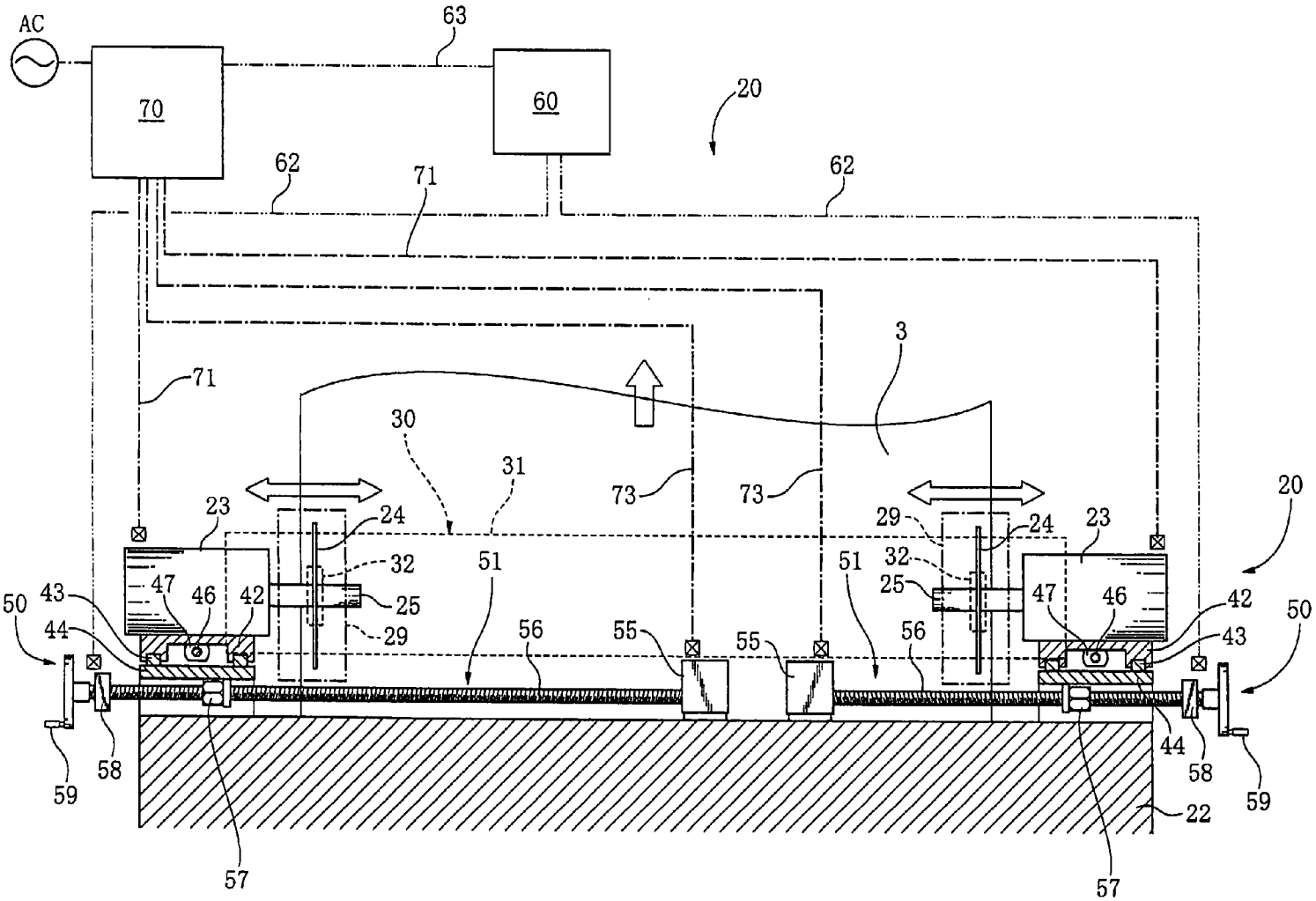
FIG. 6 is a partially cross-sectional plan view of the scoring device.
Figure 7:
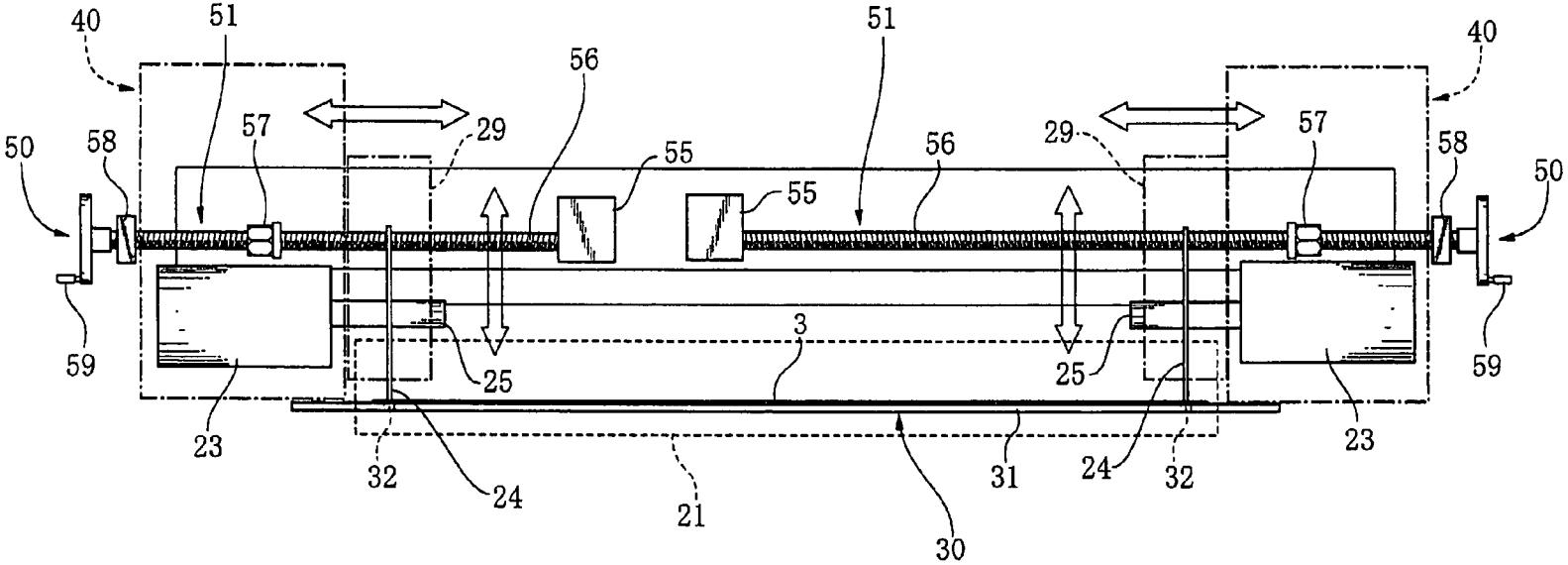
FIG. 7 is a front elevational view of the scoring device.

FIGS. 5, 6 and 7 are a partially cross-sectional side elevational view, a partially cross-sectional plan view and a front elevational view of the scoring device 11. In FIG. 5, depiction of the safety cover 29 is omitted.

Each of the scoring units 20 constituting the scoring device 11 is provided with a vertical carrier mechanism 40, a horizontal carrier mechanism 50, a vertical operation mechanism 41, and a horizontal operation mechanism 51. The vertical carrier mechanism 40 supports the electric motor 23 vertically movably. The horizontal carrier mechanism 50 supports the vertical carrier mechanism 40 horizontally displaceably. The vertical operation mechanism 41, which is a lead-screw type mechanism, vertically moves the motor 23. The horizontal operation mechanism 51, which is also a lead-screw type mechanism, horizontally moves the motor 23.

As shown in FIG. 5, the vertical carrier mechanism 40 is constituted from a slide member 42, a guide member 43 and a vertical plate 44. The slide member 42 is integrally jointed with a motor housing of the motor 23. The guide member 43 supports the slide member 42 vertically movably. The guide member 43 is fixed on the vertical plate 44. The vertical operation mechanism 41 is constituted from an electric motor 45 for vertical operation, a lead screw 46 and a nut 47. The motor 45 is fixed on an upper part of the vertical plate 43. The lead screw 46 is operatively connected to a rotary drive shaft (not shown) of the motor 45. The nut 47 is threadedly engaged on the lead screw 46 and integrally connected with the slide member 42. The lead screw 46 is rotated by the motor 45 so that the nut 47 is vertically displaced. The slide member 42 and the motor 23 are displaced vertically together with the nut 47. Thus, the operation of the motor 45 can cause the motor 23 and the blade 24 to move vertically. Preferably, the vertical operation mechanism 41 is so designed that vertical behavior of the motor 23 and the blade 24 can be carried out at 0.01 mm intervals.

The horizontal carrier mechanism 50 is constituted from slide members 52 integrally jointed to the vertical plate 44, and guide members 53 supporting the slide members 52 horizontally displaceably. The guide members 53 are fixed to the frame 22. As shown in FIGS. 6 and 7, the horizontal operation mechanism 51 is constituted from an electric motor 55 for horizontal operation, a lead screw 56 and a nut 57. The motor 55 is fixed on the frame 22. The lead screw 56 is operatively connected to a rotary drive shaft (not shown) of the motor 55. The nut 57 is threadedly engaged on the lead screw 56 and integrally connected with the plate 44. The lead screw 56 is rotated by operation of the motor 55, so that the nut 57 is horizontally displaced. The plate 44, the guide members 43, the slide member 42 and the motor 23 are displaced horizontally together with the nut 57. Thus, the operation of the motor 55 can cause the motor 23 and the blade 24 to move horizontally. Preferably, the horizontal operation mechanism 51 is so designed that vertical behavior of the motor 23 and the blade 24 can be carried out at 0.01 mm intervals.

As shown in FIGS. 5 and 6, a control system of the scoring device 11 has encoders 48, 58 and a control unit 60. The encoders 48, 58 detect rotational positions of the lead screws 46, 56. The control unit 60 is connected with the encoders 46, 56. Output signals of the encoders 46, 56 are inputted to the control unit 60 through control signal lines 61, 62. The control unit 60 detects vertical and horizontal positions of the blade 24 on the basis of the output signals of the encoders 48, 58. The control unit 60 has a memory section for memorizing the positions of the blade 24 corresponding to types of the gypsum board (sorts of the gypsum board); an arithmetic and control section for setting target positions of the blade 24 and so forth; and a touch panel for allowing an operator to select the type of the gypsum board and so forth. The data to be stored at the memory section includes, e.g., the positions of the folding lines corresponding to each of the types of gypsum boards (configurations of the edges, dimensions of the boards and so forth) and the positions of the blade 24 corresponding to the positions of the folding lines. The touch panel functions as a display for selection or presentation of information which has been already registered with respect to the types of gypsum boards and so forth. The operator can set the desired type of gypsum board, the desired positions of folding lines and the like with use of the touch panel. Further, when a new type of gypsum board is to be produced, or when the stored data in relation to the past type of gypsum board are to be renewed, the operator can input the information on the touch panel with respect to the configuration and size of edge, the positions of folding lines and so forth. The memory section newly memorizes the inputted information or carries out renewal of the past data.

The arithmetic and control section of the control unit 60 outputs driving signals, each indicating operation of the motors 45, 55, in order to move the blades 24 to their target positions corresponding to the type of gypsum board selected by the operator. The driving signal is inputted to a control panel 70 through a control signal line 63.

The control panel 70 is connected to an AC power supply and connected with the motors 23, 45, 55 by means of power lines 71, 72, 73. The control panel 70 operates the motors 45, 55 in accordance with the driving signals transmitted from the control unit 60 so as to move the blade 24 vertically and horizontally. When the control unit 60 detects the blade 24 at the target position by the output signals of the encoders 48, 58, the control unit 60 outputs stopping signals for the motors 45, 55 to the control panel 70. The control panel 7 stops the motors 45, 55 and operates the motor 23.

The control unit 60 and the control panel 70 have functions of management and control for not only operation of the scoring device 11, but also operations of the mixer 14, the conveyance device and the other devices of the gypsum board production machine 1.

The operation of the scoring device 11 is described hereinafter.

The paper roll 12 and so forth are set on the gypsum board production machine 10, and the operator selects the type of gypsum board to be produced and so forth by manual operation of the control panel 70. The control unit 60 outputs the driving signals to the control panel 70. The vertical and horizontal carrier mechanisms 40, 50 cause the blade 24 to move horizontally and vertically under control of the control unit 60. Each of the blades 24 descends as shown by dotted lines in FIG. 5, until the blade 24 is brought into contact with the upper layer of the sheet 3 in the preset target position. As previously described, the sheet 3 is ground in a range of the opening 32 (in the intimate contact area corresponding to the central angle β of the blade 24) while the sheet 3 is slightly bent downward. As the results, the groove 9 is formed on the upper surface of the sheet 3, while the folding line 9*a* is formed to protrude on the lower surface of the sheet 3, as shown in FIG. 4.

As shown in FIG. 1, the mixer 14 deposits the gypsum slurry S on the sheet 3 under control of the control unit 60 and the control panel 70. The folding devices 15 fold the edge portions of the sheet 3 upward. The sheet (upper sheet) 4 is laminated on the slurry S by the turning roller 17 or a plate (not shown). The rotary rollers 18 convey the web-like formation W of the sheets 3, 4 and the slurry S to the roughly cutting device, the dryer and the finely cutting device.

According to the scoring device 11 with the arrangement as set forth above, the sheet of paper 3 is curved downward in the range of the opening 32 and kept in contact with the blade edge 24*a* of the blade 24 in a range of the angle β. The groove 9 formed on the upper surface of the sheet 3 is stable in its depth, and the folding line 9*a* is formed relatively clearly. Therefore, the scoring device 11 can prevent rupture or tearing of the sheet 3 from being caused by irregularity of the depth of the groove 9. Thus, the scoring device 11 is suitable for reduction of the thickness of the sheet 3 and speeding-up of the gypsum board production line.

Further, since the folding line 9*a* is formed on the sheet 3 relatively clearly, the edge portion 5 of the sheet 3 can be precisely folded at the angle α=substantially right angle under the action of the folding device 15 following to the action of the scoring device 11.

Furthermore, the aforementioned scoring device 11 prevents the blade 24 and the block 30 from being worn out, so that the replacement frequency of the blade 24 and the block 30 is reduced.

In addition, the scoring device 11 can precisely and stably form the groove of a constant depth on the sheet 3 and can prevent wear of the blade 24 and the block 30. Therefore, reproducibility and stability of the scoring process are ensured. Thus, the mechanical constituents or mechanical means (vertical and horizontal carrier mechanisms 40, 50, vertical and horizontal operation mechanism 41, 51) can be operated to carry out precise setting of the blade 24 under control of the control unit 60 by means of the control panel 70. This is practically very advantageous, because mechanical and automatic setting of the blade 24 is realized independently of manual operation.

Figure 8:
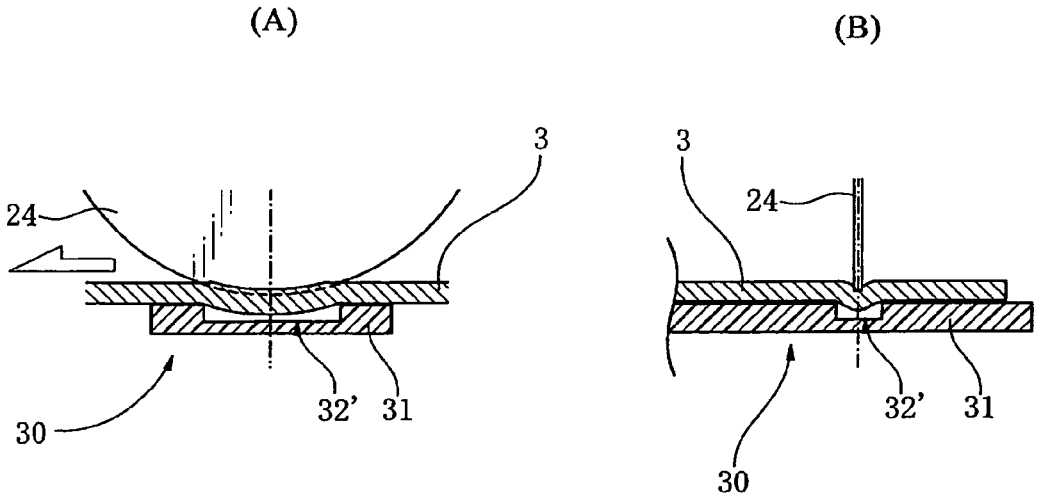
FIG. 8 includes cross-sectional views showing a modification of the backing block.
Figure 9:
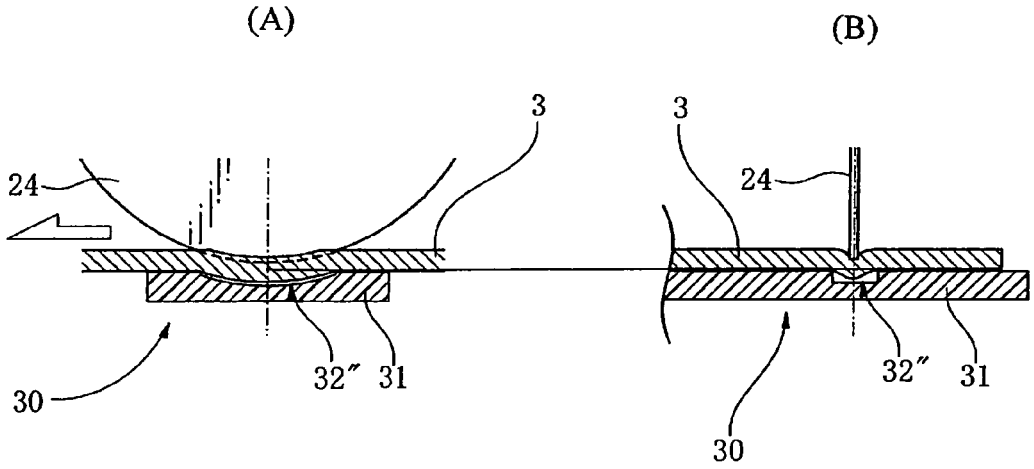
FIG. 9 includes cross-sectional views showing another modification of the backing block.
Figure 10:
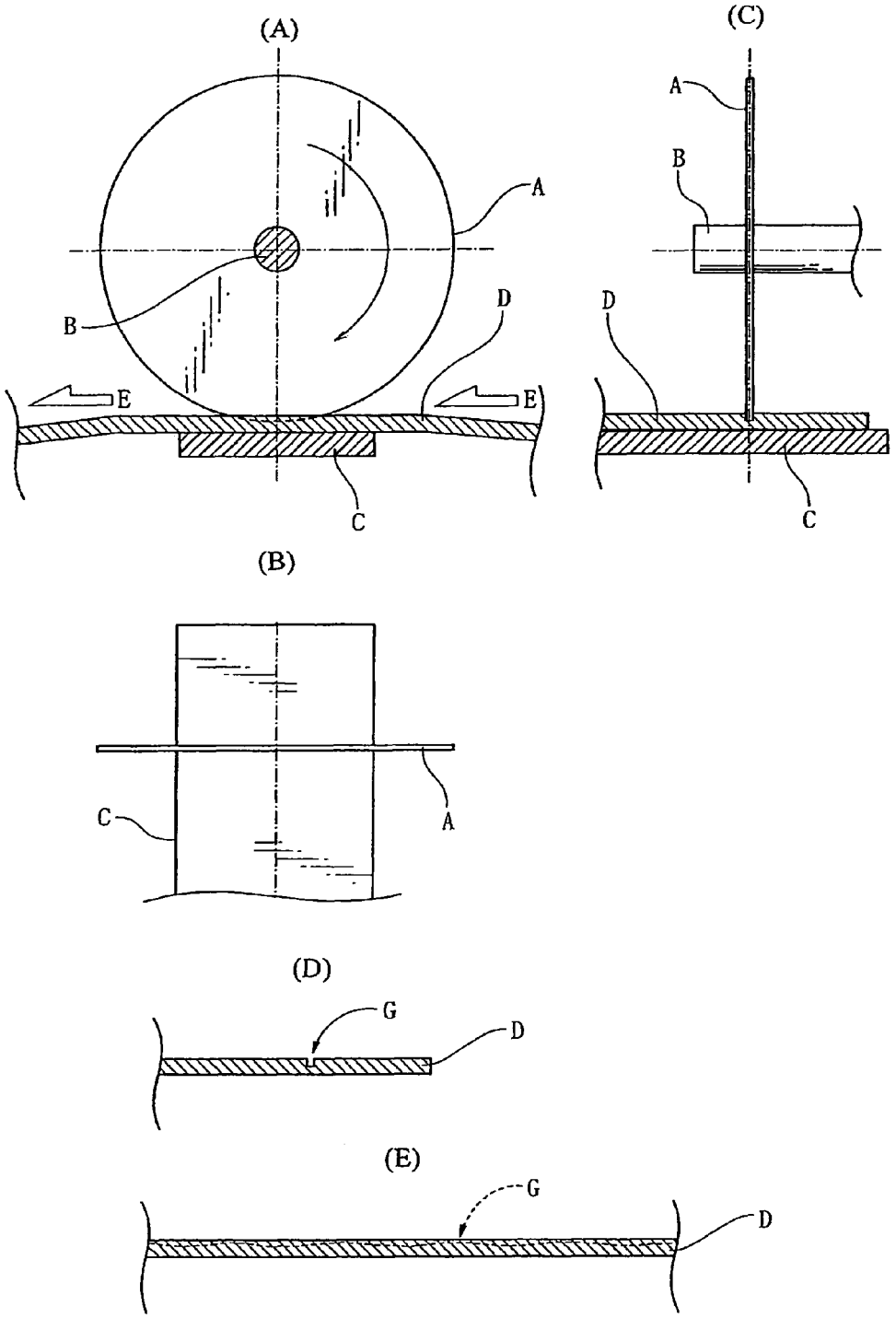
FIG. 10 PRIOR ART
FIGS. 10 (A) and 10 (B) are cross-sectional views schematically showing a structure of a conventional scoring device, FIG. 10 (C) is a partial plan view of its backing block, and FIGS. 10 (D) and 10 (E) are partial cross-sectional views of the sheet of paper for gypsum board liner showing the score formed on the sheet.

FIGS. 8 and 9 are cross-sectional views showing modifications of the backing block 30.

The blocks 30 shown in FIGS. 8 and 9 are provided with square or rectangular openings 32', 32", which are formed to be top opening square or rectangular recesses. The opening 32' (FIG. 8) has a flat bottom face, whereas the opening 32" (FIG. 9) has a bottom face which is curved in a curvature equivalent to that of the blade 24. The openings 32', 32" are formed in a range of the angle β with respect to the center axis γ (FIG. 4) of the blade 24, similarly to the aforementioned opening 32. The blade 24 forms the groove 9 on the upper surface of the sheet 3 and forms the folding line 9*a* to project from the lower surface of the sheet. The edge portion of the sheet 3 is precisely folded upward by the action of the following folding device 15.

Preferred examples of the invention have been described in detail, but the present invention is not limited thereto. A variety of variations can be implemented or a variety of changes can be made in the scope of the invention set forth in the claims.

For example, the scoring device in each of the aforementioned examples is arranged to independently move each of the blades vertically and horizontally and rotate it, but the scoring device may be so arranged that the plural blades are moved and rotated together or synchronously by means of a single mechanism or associated mechanisms.

Further, the control system of the scoring device may be so arranged that setting of the position of the blade can be appropriately changed in accordance with difference in thickness of the sheet of paper or the like.

Furthermore, in the aforementioned examples, the rotational direction of the blade is set to be a normal direction wherein the contact time is relatively long and the contact resistance is relatively reduced, but it is possible to rotate the blade in its reverse direction.

In addition, the single blade is attached to the driving shaft of the electric motor in the aforementioned examples, but a plurality of blades may be provided on or attached to the single driving shaft in parallel.

The present invention is applied to the scoring device for the gypsum board production machine. According to the scoring device of this invention, the groove having the constant depth can be accurately and stably formed on the sheet of paper for gypsum board liner, and wear of the blade and the backing block can be prevented, and therefore, the replacement frequency of the blade and the block can reduced. Also, the present invention may be applied to various scoring devices for continuously forming a score on a sheet of paper traveling under tension.

The invention claimed is:

1. A scoring device of a whetstone type for a gypsum board production machine having a rotary blade and a backing block stationarily positioned under the rotary blade and having an upper flat surface, comprising:

a space for downward deformation of the sheet of paper for gypsum board liner, which is formed in the backing block and which opens on the upper flat surface of the backing block, and tensioning means for stably imposing tension on the sheet traveling on the upper flat surface of the block, wherein a blade edge of the rotary blade scrapes an upper surface portion of a sheet of paper for gypsum board liner traveling under tension, the upper flat surface of the backing block abuts against a lower surface of the sheet for the travelling of the sheet, a score is continuously ground on the sheet by the blade edge, an opening of the space has an edge defining the space on the upper flat surface and is located immediately under the rotary blade made of whetstone, so that a part of the sheet to be ground is downwardly released by the opening, and the backing block and the blade edge are so positioned as to cause the sheet under tension to be slightly bent downward in a range of the opening for keeping intimate contact between the blade edge and the upper surface of the sheet throughout an angular range of a predetermined central angle (β) about a rotational center axis of the rotary blade and maintaining a grinding action of the blade edge on the upper surface portion of the sheet in the angular range, so that said upper surface portion is scraped from the sheet of paper to make a groove on the upper surface of the sheet while making a folding line protruding from a lower surface of the sheet in said range of the opening, by the grinding action of the blade edge, wherein the central angle is set to be in a range from 10 degrees to 90 degrees.

2. A scoring device as defined in claim 1, further comprising a carrier mechanism which movably supports a driving device for rotating the blade, and a moving mechanism which moves the driving device.

3. A scoring device as defined in claim 2, wherein the carrier mechanism has a vertical carrier mechanism which movably supports the driving device in a vertical direction, and a horizontal carrier mechanism which movably supports the vertical carrier mechanism in a horizontal direction; and wherein the moving mechanism has a vertical driving mechanism which vertically moves the driving device, and a horizontal driving mechanism which horizontally moves the driving device.

4. A scoring device as defined in claim 2, further comprising detecting means for detecting a position of the blade, and a controller operating the moving mechanism on the basis of a detected result of the detecting means.

5. A scoring device as defined in claim 4, wherein the controller has a memory section for storing positional information of the blade in relation to a dimension and a configuration of the gypsum board.

6. A scoring device as defined in claim 1, wherein the blade edge is made of diamond whetstone.

7. A scoring device as defined in claim 1, wherein the blade edge of the blade is a flat type of blade edge.

8. A scoring device as defined in claim 1, wherein the space is a through-hole vertically extending through the backing block.

9. A scoring device as defined in claim 1, wherein the space is an open-topped recess formed on an upper surface of the backing block.

10. A method of producing a gypsum board with use of the scoring device as defined in claim 1, comprising:

scoring an upper surface of a sheet of paper for gypsum board liner traveling on an upper flat surface of a backing block under tension with use of a rotary blade of a scoring device of a whetstone type having a blade edge made of whetstone, so that a folding line is continuously ground on the upper surface of the sheet while the backing block stationarily positioned under said blade is in contact with a lower surface of the sheet, wherein the backing block causes a portion of the sheet to be downwardly released through an opening formed on the backing block immediately below the blade edge, and the backing block and the blade edge are so positioned as to cause the sheet under tension to be slightly bent downward in a range of the opening for keeping intimate contact between the blade edge and the upper surface of the sheet in an angular range of a predetermined central angle (β) with respect to a rotational center axis of the blade and maintaining a grinding action of the blade edge on the upper surface of the sheet in the angular range, so that an upper surface portion of the sheet of paper is scraped from the sheet, to make a groove on the upper surface of the sheet while making a folding line protruding from a lower surface of the sheet in the range of the opening, by the grinding action of the blade edge, wherein the central angle (β) is set to be in a range from 10 degrees to 90 degrees.

11. A scoring device as defined in claim 1, wherein said tensioning means includes tension rolls disposed on both sides of the backing block in a travelling direction of the sheet.

12. A scoring device as defined in claim 1, wherein said opening has a square or rectangular profile on the upper flat surface of the block.

13. A scoring device of a whetstone type for manufacturing a gypsum board, comprising:

a rotary blade having a blade edge made of whetstone, the blade edge scraping an upper surface portion of a sheet of paper for gypsum board liner traveling under tension, and continuously forming a score ground on the sheet; and a backing block stationarily positioned under said blade and having an upper flat surface in contact with a lower surface of the sheet, for the traveling of the sheet, and tension rolls configured to stably impose tension on the sheet travelling on the upper flat surface of the block, which are disposed on both sides of the backing block in a travelling direction of the sheet, wherein the backing block has a space for downward deformation of the sheet, which is formed in the block and which has an opening immediately below the blade for downwardly releasing a part of the sheet to be ground by the blade, and the backing block and the blade edge are so positioned as to cause the sheet under tension to be slightly bent downward in a range of the opening for keeping intimate contact between the blade edge and the upper surface portion of the sheet throughout an angular range of a predetermined central angle (β) about a rotational center axis of the blade and maintaining a grinding action of the blade edge on the upper surface portion of the sheet in the angular range, so that said upper surface portion is scraped from the sheet of paper to make a groove on an upper surface of the sheet while making a folding line protruding from a lower surface of the sheet in said range of the opening, by the grinding action of the blade edge, wherein the central angle (β) is set to be in a range from 10 degrees to 90 degrees.

14. A scoring device as defined in claim 13, wherein the space is a through-hole vertically extending through the backing block or an open-topped recess formed on an upper surface of the backing block.

15. A scoring device as defined in claim 13, wherein said opening has a square or rectangular profile on the upper flat surface of the block.

* * * * *

UNITED STATES PATENT AND TRADEMARK OFFICE

CERTIFICATE OF CORRECTION

PATENT NO. : 9,138,906 B2
APPLICATION NO. : 12/312038
DATED : September 22, 2015
INVENTOR(S) : Shoichi Okazaki et al.

It is certified that error appears in the above-identified patent and that said Letters Patent is hereby corrected as shown below:

In the Specification

Column 1, Line 3

Please insert -- CROSS REFERENCE TO RELATED APPLICATIONS

This application claims the benefit under 35 U.S.C. Section 371, of PCT International Application No. PCT/JP2007/070859, filed October 25, 2007, which claimed priority to Japanese Application No. 2006-302158, filed November 17, 2006 in the Japanese Patent Office, the disclosures of which are hereby incorporated by reference. --

Signed and Sealed this
Ninth Day of February, 2016

Michelle K. Lee

Michelle K. Lee
*Director of the United States Patent and Trademark Office*